US011279502B2

(12) United States Patent
Hoepfer et al.

(10) Patent No.: US 11,279,502 B2
(45) Date of Patent: Mar. 22, 2022

(54) POWDER PROVISIONING DEVICE FOR A POWDER DOSER

(71) Applicant: Harro Hoefliger Verpackungsmaschinen GmbH, Allmersbach im Tal (DE)

(72) Inventors: Jonas Hoepfer, Allmersbach im Tal (DE); Marco Weigel, Allmersbach im Tal (DE)

(73) Assignee: Harro Hoefliger Verpackungsmaschinen GmbH, Allmersbach im Tal (DE)

( * ) Notice: Subject to any disclaimer, the term of this patent is extended or adjusted under 35 U.S.C. 154(b) by 451 days.

(21) Appl. No.: 16/534,784

(22) Filed: Aug. 7, 2019

(65) Prior Publication Data

US 2020/0047925 A1 Feb. 13, 2020

(30) Foreign Application Priority Data

Aug. 8, 2018 (EP) ..... 18187934

(51) Int. Cl.
*B65B 35/34* (2006.01)
*B65B 1/36* (2006.01)
*B65B 1/10* (2006.01)

(52) U.S. Cl.
CPC ..... *B65B 1/36* (2013.01); *B65B 1/10* (2013.01); *B65B 35/34* (2013.01)

(58) Field of Classification Search
CPC ..... B65B 35/34; B65B 1/10
See application file for complete search history.

(56) References Cited

U.S. PATENT DOCUMENTS

| | | | | |
|---|---|---|---|---|
| 2,615,690 | A * | 10/1952 | Jepson | A47J 43/044 366/197 |
| 3,656,718 | A * | 4/1972 | Cairelli | A47J 43/044 366/200 |
| 5,836,688 | A | 11/1998 | Eping | |
| 8,267,573 | B2 | 9/2012 | Wilson | |
| 9,642,812 | B2 * | 5/2017 | Penachio | A61P 25/16 |
| 2003/0131905 | A1 * | 7/2003 | Duffield | B30B 15/302 141/284 |
| 2011/0249527 | A1 | 10/2011 | Seiler et al. | |

FOREIGN PATENT DOCUMENTS

| | | | |
|---|---|---|---|
| DE | 4429244 | A1 | 2/1996 |
| DE | 102008054842 | A1 | 7/2010 |
| WO | 2005089606 | A1 | 9/2005 |

* cited by examiner

*Primary Examiner* — Jason K Niesz
(74) *Attorney, Agent, or Firm* — Walter Ottesen, P.A.

(57) ABSTRACT

A powder provisioning device is for a powder doser, in particular for a tamping pin station. The powder provisioning device comprises a powder container, which can be driven in rotation, for receiving a powder bed, and a stationarily mounted smoothing device for the powder bed. The stationarily mounted smoothing device includes a stirring unit having at least one stirrer which projects into the interior of the powder container and can be driven in rotation.

9 Claims, 2 Drawing Sheets

POWDER PROVISIONING DEVICE FOR A POWDER DOSER

CROSS REFERENCE TO RELATED APPLICATION

This application claims priority of European patent application no. 18 187 934.7, filed Aug. 8, 2018, the entire content of which is incorporated herein by reference.

BACKGROUND OF THE INVENTION

In the dosing of powders, in particular via so-called tamping pins, the quantity of powder to be dosed is isolated by inserting a sleeve into a powder bed, which is held ready in a powder container. The isolated quantity of powder is compacted in the sleeve via a plunger. The sleeve with the isolated quantity of powder contained therein is then withdrawn from the powder bed. The powder container is then rotated, together with its powder bed contained therein, relative to the stationarily positioned doser so that the tamping pin sleeve of the doser is able to plunge into a fresh region of the powder bed.

The procedure outlined above leaves behind puncture craters in the powder bed, which must be closed again as the powder container continues to rotate. However, the nature of many types of powder is such that the craters do not close by themselves in every case. In order to assist with the closing process, a stationarily mounted smoothing device is therefore used, which in the prior art includes rakes and guide plates. As a result of the relative movement of the powder bed, which rotates with the powder container, relative to the stationary rakes and guide plates, the craters should close.

However, the mentioned components, specifically the rakes and guide plates, which hang passively in the powder bed, have the disadvantage that they generate a wake behind them in the direction of movement, that is, cast a "shadow" as it were, which forms a furrow-like depression in the powder bed and in addition locally changes the density of the powder. If a sleeve is then inserted into such a furrow, the fill quantity thereof is reduced as compared with those sleeves which plunge into a region of the powder bed without a furrow. Moreover, in the prior art, the rakes and guide plates are adjusted manually. Their action is scarcely reproducible, is sensitive to changes of any kind and, in addition, is speed-dependent.

SUMMARY OF THE INVENTION

It is an object of the invention to provide a generic powder provisioning device in such a manner that a powder bed in a more uniform and better reproducible state can thereby be provided.

According to the disclosure there is provided a powder provisioning device for a powder doser. The stationarily mounted smoothing device of the powder provisioning device includes a stirring unit having at least one stirrer which projects into the interior of the powder container and can be driven in rotation. The stirrer effects reliable leveling of puncture craters in the powder bed, without adversely affecting the powder properties such as powder density or the like. Unlike a passive, that is non-moving, element, the stirring rotating movement of the stirrer has the result that its action within a specific range is homogeneous. Locally depressed furrows do not form in the wake of the stirrer. Instead, the stationarily but rotatably mounted and driven stirrer generates a broad and uniform wake in the powder bed moved relative thereto, within which the tamping pin(s) find reproducible dosing conditions.

It can be advantageous that the at least one stirrer enters the interior of the powder container, or the powder bed, with its axis of rotation inclined relative to the vertical. Preferably, however, it has a vertically oriented axis of rotation. This has the result that the stirring action does not have any substantial vertical or axial components. This contributes towards further homogenizing the powder surface, or the height of the powder, while avoiding local elevations or depressions.

In a further embodiment, the stirring unit has two interengaging stirrers which can be driven in opposite directions. In respect of the relative rotating movement of the powder container together with the powder bed relative to the stirring unit, a symmetrical stirring action with further improved uniformity is produced.

The stirrer can advantageously have at least one axial mixing element and/or one radial mixing element. An axial mixing element here means a mixing element which extends at least in part in the direction of the axis of rotation of the stirrer. A radial mixing element here means a mixing element which extends at least in part in the radial direction relative to the axis of rotation of the stirrer. The orientation does not have to be an exact axial or radial orientation. Instead, embodiments which extend obliquely to the respective directions and thereby exhibit only in part a directional component in respect of the mentioned directions are also included. In any case, it is thus ensured that the mixing action within a target volume of the powder bed occurs with pronounced uniformity.

In an embodiment, the rotating movement of the stirrer is coupled to the rotating movement of the powder container. The motion of the stirrer is thus synchronized with the motion of the powder container. The action of the stirrer is consequently independent of the operating speed. This in particular also allows a cyclical operation with acceleration and retardation phases in which the preparation of the powder bed always takes place uniformly despite varying speeds.

Overall, the result is that preparation of the powder bed takes place with considerably improved reproducibility and uniformity. Virtually no adjustments are necessary. The dosing accuracy of the powder removed from the powder provisioning device is increased significantly.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
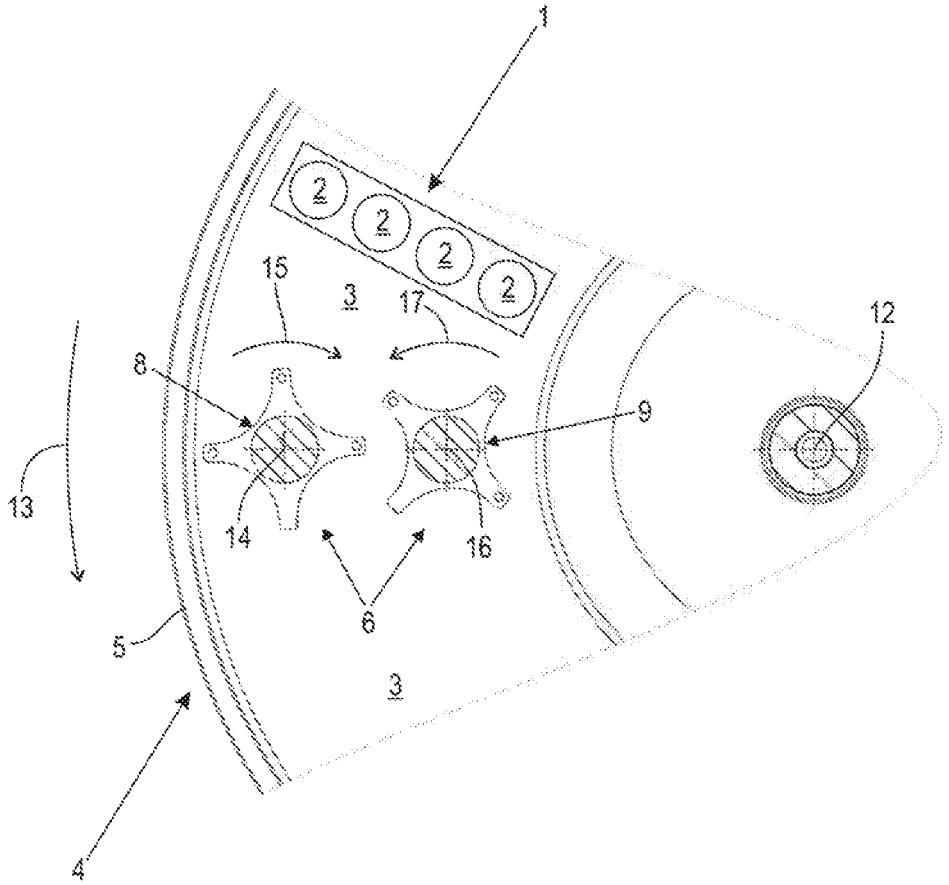
FIG. 1 shows, in a schematic top view, a system including a powder doser and a powder provisioning device having two stirrers driven in opposite directions; and, FIG. 2 shows, in a sectional representation, the powder provisioning device according to FIG. 1 with details of its smoothing device in the form of a stirring unit.

FIG. 1 shows, in a schematic top view, a detail of a system which includes a powder doser 1 and a powder provisioning device 4 for the powder doser 1. Part of the powder provisioning device 4 is a powder container 5, in which a powder bed 3 of a pulverulent product is held ready. The pulverulent product is here a pharmaceutical preparation.

However, other pulverulent products also come into consideration for forming the powder bed 3 and for processing via the powder provisioning device 4. Via the powder doser 1, partial quantities of the pulverulent product are removed from the powder bed 3 and each isolated as a defined dosing quantity. In the embodiment shown, the powder doser 1 is a tamping pin station, shown only schematically, with, for example, four adumbrated tamping pins 2 whose cylindrical sleeves plunge into the powder bed 3 from above, that is, perpendicular to the plane of the drawing of FIG. 1, where they each, in known manner, isolate a powder quantity, compact it and remove it for further processing, in particular for transfer to target containers (not shown). Instead of the tamping pin station, other forms of a powder doser 1 can, however, also be used.

Figure 2:
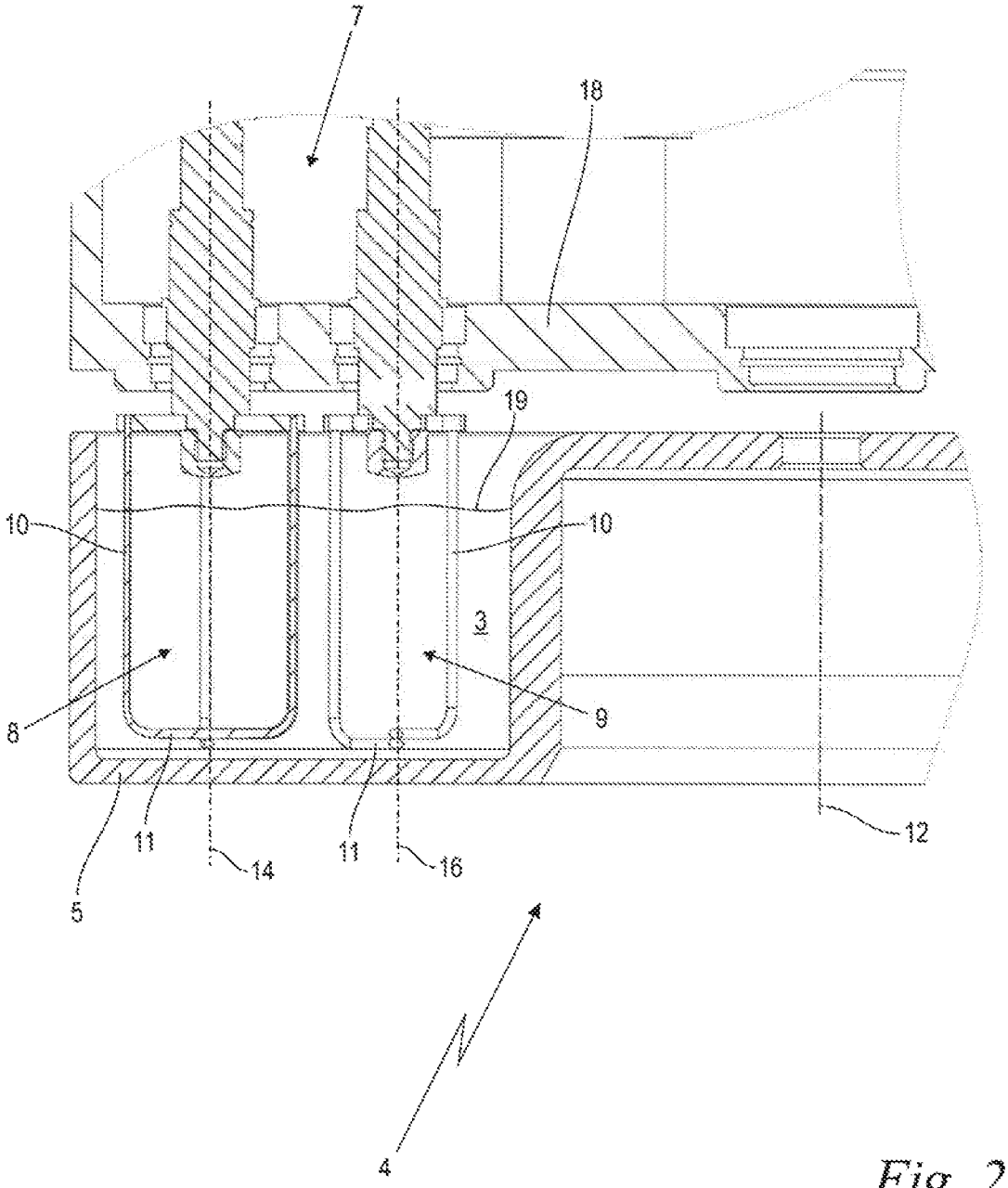

In addition to the mentioned cup-shaped powder container 5, the powder provisioning device 4 includes a smoothing device 6 for the powder bed 3, further details of which will become apparent from considering FIG. 1 together with FIG. 2. FIG. 2 shows, in a sectional representation, the powder provisioning device according to FIG. 1 in a sectional plane perpendicular to the plane of the drawing according to FIG. 1. It is apparent from considering FIGS. 1 and 2 together that the smoothing device 6, like the powder doser 1, is mounted stationarily, while the powder container 5 is mounted to be rotatable about a vertical axis of rotation 12 and, during operation, is driven in rotation about that axis of rotation according to an arrow 13 (FIG. 1). The powder bed 3 in the powder container 5 follows this rotating movement, so that it performs a relative movement relative to the fixedly positioned powder doser 1 and also relative to the fixedly positioned smoothing device 6.

The mentioned rotating movement of the powder container 5 and the powder bed 3 about the axis of rotation 12 is intermittent or cyclic. During the measuring of the individual powder dosing quantities as outlined above, that is, when the tamping pin sleeve plunges into the powder bed 3 and until the withdrawal thereof, the rotating movement is stopped. The rotating movement of the unit including the powder container 5 and the powder bed 3 is then started and again stopped after a defined angular step has been executed, whereupon the measuring and dosing step begins again. According to the representation of FIG. 2, the powder bed 3 has a surface 19 in which the tamping pins 2 (FIG. 1) leave behind craters after they have been withdrawn. The execution of the mentioned angular step contributes towards the powder doser 1, at each measuring or dosing operation, finding a powder bed 3 having a surface 19 which has properties that are as homogeneous as possible and which is as undisturbed as possible.

Any craters present in the surface 19, or also other disturbances in the powder bed 3 caused by the powder doser 1, initially travel with the rotating movement of the powder container 5 in the direction of the arrow 13. In order to eliminate such disturbances, the smoothing device 6 already mentioned above for the powder bed 3 is positioned behind the powder doser 1 in the direction of rotation (arrow 13). The smoothing device 6 includes a stirring unit 7, which in turn includes at least one, here two stirrers 8, 9. The two stirrers 8, 9 have drive shafts via which they are rotatably mounted in a stationary bearing plate 18 which does not rotate with the powder container. One stirrer 8 has a vertical axis of rotation 14 and the other stirrer 9 has a vertical axis of rotation 16. The two axes of rotation 14, 16 of the stirrers 8, 9 are axially parallel to one another and also axially parallel to the axis of rotation 12 of the powder container 5.

The two stirrers 8, 9 each have at least one, here four axial mixing elements 10 and, optionally, also at least one, here four radial mixing elements 11, each made of bent wire. The axial mixing elements 10 run parallel to the respective axis of rotation 14, 16, but they can also lie at an oblique angle thereto and extend, for example, helically. The radial mixing elements run radially to the respective axis of rotation 14, 16. They also do not have to have exactly that profile but can also lie at an oblique angle thereto and extend, for example, spirally. The stirrers 8, 9 are so positioned that they project with their axial and radial mixing elements 10, 11 into the interior of the powder container 5 and there into the powder bed 3. The depth of penetration of the stirrers 8, 9 beneath the surface 19 of the powder bed 3 reaches almost to the bottom of the powder container 5. In any case, it is preferably at least as great as the depth of penetration of the tamping pins 2.

It is also apparent from the top view according to FIG. 1 that the two stirrers 8, 9 lie in the same relative position to the powder doser 1 in the direction of rotation of the powder container 5, but are spaced apart from one another in the radial direction. However, an offset position of the two stirrers 8, 9 in the direction of rotation of the powder container 5 can also be advantageous. Moreover, it can be seen in FIG. 1 that, in operation, the two stirrers 8, 9 are driven in opposite directions about their respective axes of rotation 14, 16, as is indicated by arrows 15, 17. The spacing of the two axes of rotation 14, 16 is smaller than the diameter of the stirrers 8, 9, and consequently the mixing elements 10, 11 of the two stirrers 8, 9 mesh with one another. The mixing elements 10, 11 are prevented from colliding with one another by suitably offsetting the angles of rotation. Overall, the two stirrers 8, 9 generate an effective width with no gaps which extends radially to the axis of rotation 12 of the powder container 5 to such an extent that the effective width, likewise measured radially to the axis of rotation 12 of the powder container 5, of the powder doser 1, or of all its tamping pins 2, is completely covered. The wake of the powder doser 1 as a whole which forms in the powder bed 3 is completely covered by the mixing elements 10, 11.

The rotating movement of the two stirrers 8, 9 is coupled to the rotating movement of the powder container 5. This can be effected, for example, by a common drive and a mechanical forced coupling via toothed wheels, but also via a suitable electronic control system with separate drives. In any case, the stirrers 8, 9 stop when the powder container 5 stops. And they rotate when the powder container 5 also performs a rotating movement. In acceleration and retardation phases of the powder container 5, the stirrers 8, 9 also perform correspondingly accelerated or retarded rotating movements.

Overall, via the stirring unit 7, disturbances of the powder bed 3 in the wake of the powder doser 1 are eliminated, and the powder doser 1 is continuously supplied with a powder bed 3 having homogeneous powder properties and having a surface 19 at a constant height.

It is understood that the foregoing description is that of the preferred embodiments of the invention and that various changes and modifications may be made thereto without departing from the spirit and scope of the invention as defined in the appended claims.

What is claimed is:

1. A method of operating a powder provisioning device for a powder doser, the powder provisioning device having a powder container, which can be driven in rotation, for receiving a powder bed, and the powder provisioning device further having a stationarily mounted smoothing device for the powder bed, the stationarily mounted smoothing device including a stirring unit having at least one stirrer which projects into the interior of the powder container, the method comprising the step of:

driving the at least one stirrer which projects into the interior of the powder unit in rotation.

2. The method of claim 1, wherein the at least one stirrer has a vertically oriented axis of rotation.

3. The method of claim 1, wherein the stirring unit has two interengaging stirrers which can be driven in opposite directions.

4. The method of claim 1, wherein the stirrer has at least one axial mixing element.

5. The method of claim 1, wherein the stirrer has at least one radial mixing element.

6. The method of claim 1, wherein the rotating movement of the stirrer is coupled in a synchronized manner to a rotating movement of the powder container.

7. The method of claim 1, wherein the powder doser is a tamping pin station.

8. A powder provisioning device for a powder doser, the powder provisioning device comprising:

a powder container for receiving a powder bed;

said powder container defining an interior and being configured to be driven in rotation in a first rotating movement;

a stationarily mounted smoothing device for said powder bed;

said stationarily mounted smoothing device including a stirring unit having at least one stirrer which projects into said interior of said powder container;

said at least one stirrer being configured to be driven in rotation in a second rotating movement;

said second rotating movement of said at least one stirrer being coupled in a synchronized manner to said first rotating movement of said powder container.

9. The powder provisioning device of claim 8, wherein said powder doser is a tamping pin station.

* * * * *